United States Patent [19]

Bristow et al.

[11] Patent Number: 4,592,832

[45] Date of Patent: Jun. 3, 1986

[54] PROCESS FOR INCREASING BRIGHT STOCK RAFFINATE OIL PRODUCTION

[75] Inventors: Duncan J. Bristow; Biddanda U. Achia, both of Sarnia; Lawrence J. Evers, Brights Grove, all of Canada

[73] Assignee: Exxon Research and Engineering Co., Florham Park, N.J.

[21] Appl. No.: 648,013

[22] Filed: Sep. 6, 1984

[51] Int. Cl.[4] ..... C10G 21/00

[52] U.S. Cl. ..... 208/309; 208/315

[58] Field of Search ..... 208/309, 314, 315, 312, 208/337

[56] References Cited

U.S. PATENT DOCUMENTS

| | | | |
|---|---|---|---|
| 2,079,886 | 5/1937 | Voorhees | 208/315 |
| 2,146,147 | 2/1939 | Keith, Sr. et al. | 208/314 |
| 2,163,245 | 6/1939 | Laughlin | 208/309 |
| 2,570,044 | 10/1951 | Benedict et al. | 208/315 |
| 2,889,262 | 6/1959 | Porter et al. | 208/309 |
| 2,939,838 | 6/1960 | Murphey | 208/312 |
| 3,074,882 | 1/1963 | Gross et al. | 208/315 |
| 4,168,226 | 9/1979 | White et al. | 208/326 X |
| 4,419,227 | 12/1983 | Sherman | 208/326 |

*Primary Examiner*—Andrew H. Metz
*Assistant Examiner*—Glenn A. Caldarola
*Attorney, Agent, or Firm*—Robert J. North; Joseph J. Allocca

[57] ABSTRACT

A process for increasing the production of Bright Stock oil in a lube oil process scheme. Aromatic extract oil, after being separated from the extraction solvent, is recycled back to the deasphalter unit and combined with a vacuum residuum in 10–20 LV %, based on the total deasphalter feed, prior to deasphalting. After deasphalting and aromatics extraction the absolute yield of raffinate is increased.

5 Claims, 3 Drawing Figures

DEASPHALTING: EXTRACT OIL RECYCLE

DEASPHALTING: EXTRACT OIL RECYCLE

PROCESS FOR INCREASING BRIGHT STOCK RAFFINATE OIL PRODUCTION

BACKGROUND OF THE INVENTION

The present invention relates to lube oil manufacture and more specifically, is directed to increased production of Bright Stock raffinate oil.

Bright Stock raffinate oil is a high-boiling hydrocarbon fraction produced during lube oil manufacture and is well-known in the art. Generally, in the art, after a vacuum residuum, suitable for lube oil production, has been deasphalted by contacting and extracting with a propane solvent, the propane solvent is stripped off and the resulting extract oil is extracted with an aromatic solvent, such as N-methylpyrrolidone (NMP), to remove aromatic hydrocarbons. The resulting extracted, deasphalted oil phase, containing mainly saturated hydrocarbons, is known in the trade as "Bright Stock raffinate oil". This raffinate is subsequently contacted with extracting agents like ketones or alkane hydrocarbon solvents to remove waxy hydrocarbons which are detrimental to lube oil viscosity properties and then subjected to HYDROFINING TM improve the appearance of the oil and remove sulfur. The resulting oil is termed "Bright Stock Oil" and is a lubes base stock component from which many lubricating oils, e.g., gear oil, machine oil, automobile engine oil, are made by blending with other lube stock components.

A current practice in the industry, following NMP extraction of deasphalted oil in a lubes process, is to strip off the NMP from the extracted phase and send the residual extract oil, containing mostly aromatics and some dissolved recoverable Bright Stock raffinate oil, to a different process involving a catalytic cracker unit for processing to produce fuel oils. Such practice results in a yield debit for Bright Stock raffinate oil in the lube oil process and ultimately the Bright Stock base oil yield. This step is performed primarily because it is believed that recycling said extract oil again through the extraction step would result in a very low recovery of recoverable raffinate which may not be justified in light of the attendant recycling cost and process time required.

An example of the prior art in the area is U.S. Pat. No. 2,570,044 which discloses recycling of an aromatic extract oil stream derived from a deasphalted oil to a deasphalter feed during lubes production. This is disclosed as being carried out in order to eliminate the formation of a third phase which tends to foul the deasphalter internals.

In addition, the patent claims that the overall yield of high Viscosity Index (VI) components is increased relative to a conventional scheme without extract oil recycle. The aforementioned patent also teaches that the quantity of extract oil recycled to prevent asphaltic deposition is from 3 to 25 percent by volume (LV %) based on the reduced crude oil charged to the deasphalting treater tower. Furthermore, it is stated that recycling larger amounts (greater than 25 LV %) of extract oil is not disadvantageous but actually increases the yield of high Viscosity Index (VI) oil.

SUMMARY OF THE INVENTION

It has been found, in direct contrast to the teaching of the above-identified patent, that for the production of lubes Bright Stock raffinate oil within specifications, there is a distinct range for extract oil recycle being from 10 to 20 LV % based on the total reduced crude feed to the deasphalter. Adding extract oil in excess of 20 LV %, results in a dewaxed raffinate oil Conradson Carbon Residue (CCR) exceeding the equivalent of 1.0 weight percent. This leads to unacceptable Bright Stock Conradson Carbon Residue values exceeding the required specification of <0.7 wt. % with conventional downstream processing. Values of CCR exceeding specification arise due to the high CCR content of Bright Stock extract oil. In addition, it has been found that a substantial deasphalting yield credit results with extract oil recycle accompanied by an extraction yield debit. As a result of the operation of these two features, the maximum yield of high VI oil occurs between 10 and 20 LV % extract oil recycle and adding in excess of 20 LV % actually causes the overall yield to begin to decrease. The subject process is particularly useful in refinery operations being conducted under crude-limited conditions.

In accordance with this invention there is provided in a process for increasing the amount of Bright Stock raffinate oil derived from the solvent extraction of deasphalted lube oil involving the steps of:

(a) extracting a vacuum residuum with a low molecular weight alkane hydrocarbon solvent resulting in a deasphalted lube oil and asphaltic residue;

(b) separating said deasphalted lube oil and said residue;

(c) separating said hydrocarbon solvent from said deasphalted lube oil;

(d) extracting said deasphalted lube oil obtained from step (c) with an aromatics solvent resulting in a Bright Stock raffinate oil solution and an extract oil solution, said extract oil solution comprised of dissolved aromatics and recoverable raffinate;

(e) separating said raffinate oil solution from said extract oil solution obtained from step (d); and (f) separating said aromatics solvent from said extract oil solution obtained from step (e); in which said improvement comprises the steps of:

(g) recycling said extract oil, from which the aromatics solvent has been removed, obtained from step (f), to step (a) and combining said extract oil with said vacuum residuum, in a 10–20 LV %, based on said residuum, prior to said deasphalting;

(h) repeating step (a);

(i) repeating step (b);

(j) repeating step (c);

(k) extracting said deasphalted oil obtained from step (j) with said aromatics solvent resulting in said Bright Stock raffinate oil and said extract oil, wherein said obtained raffinate is present in a substantially greater amount, based on said vacuum residuum, as compared to said raffinate obtained in step (d).

BRIEF DESCRIPTION OF THE DRAWINGS

FIG. 2 illustrates three different plots obtained by practice of the subject invention showing the variation, as a function of extract oil recycle in LV %; of:

(a) the deasphalted oil (DAO) yield based on total deasphalter feed;

(b) raffinate yield based total extraction unit feed; and (c) raffinate yield based on total deasphalter unit feed.

Figure 3:
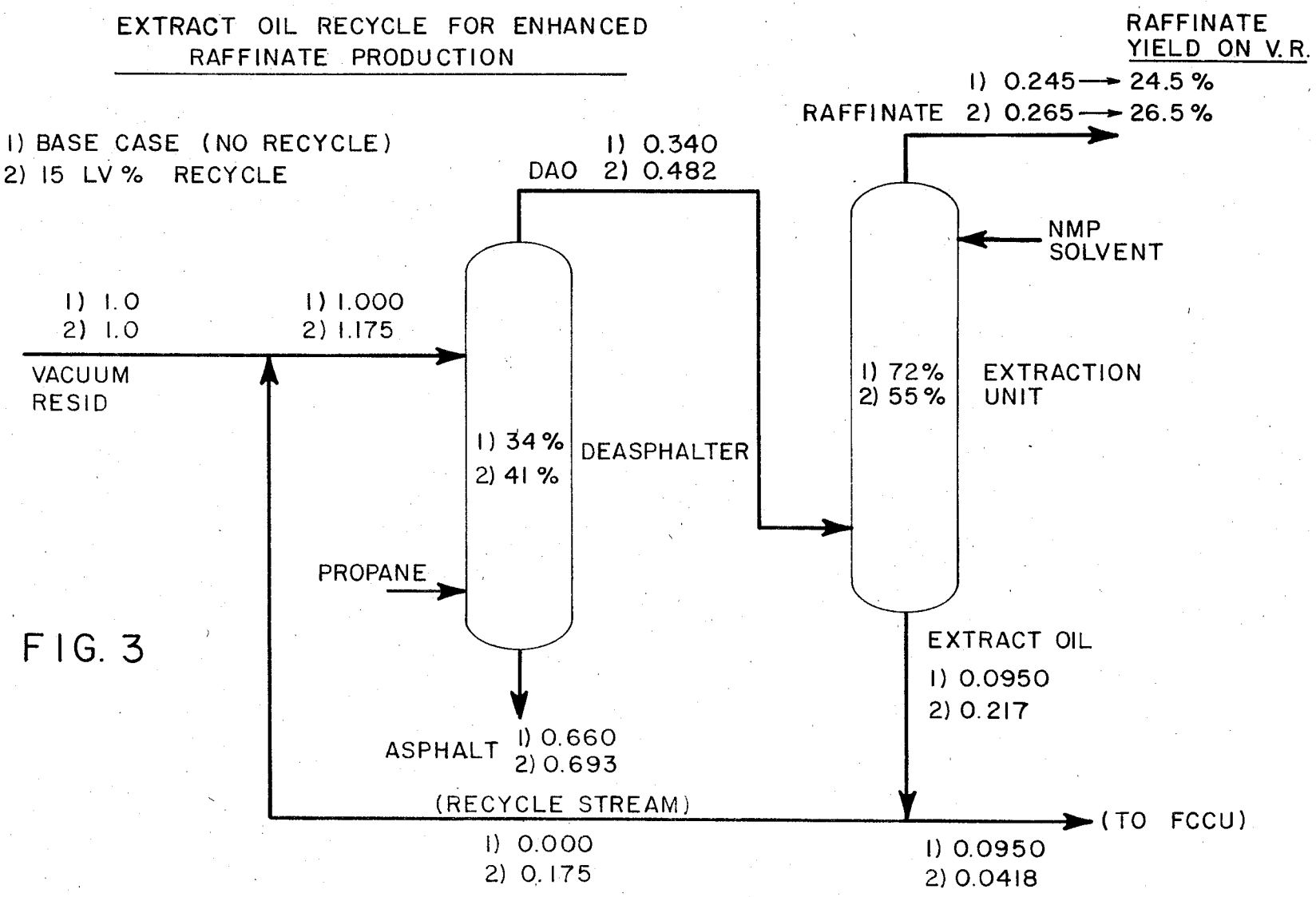

FIG. 3 is a process schematic diagram showing the increased raffinate yield in using extract oil recycle vs. the base case (no recycle).

DETAILED DESCRIPTION OF THE INVENTION AND PREFERRED EMBODIMENTS

Figure 1:
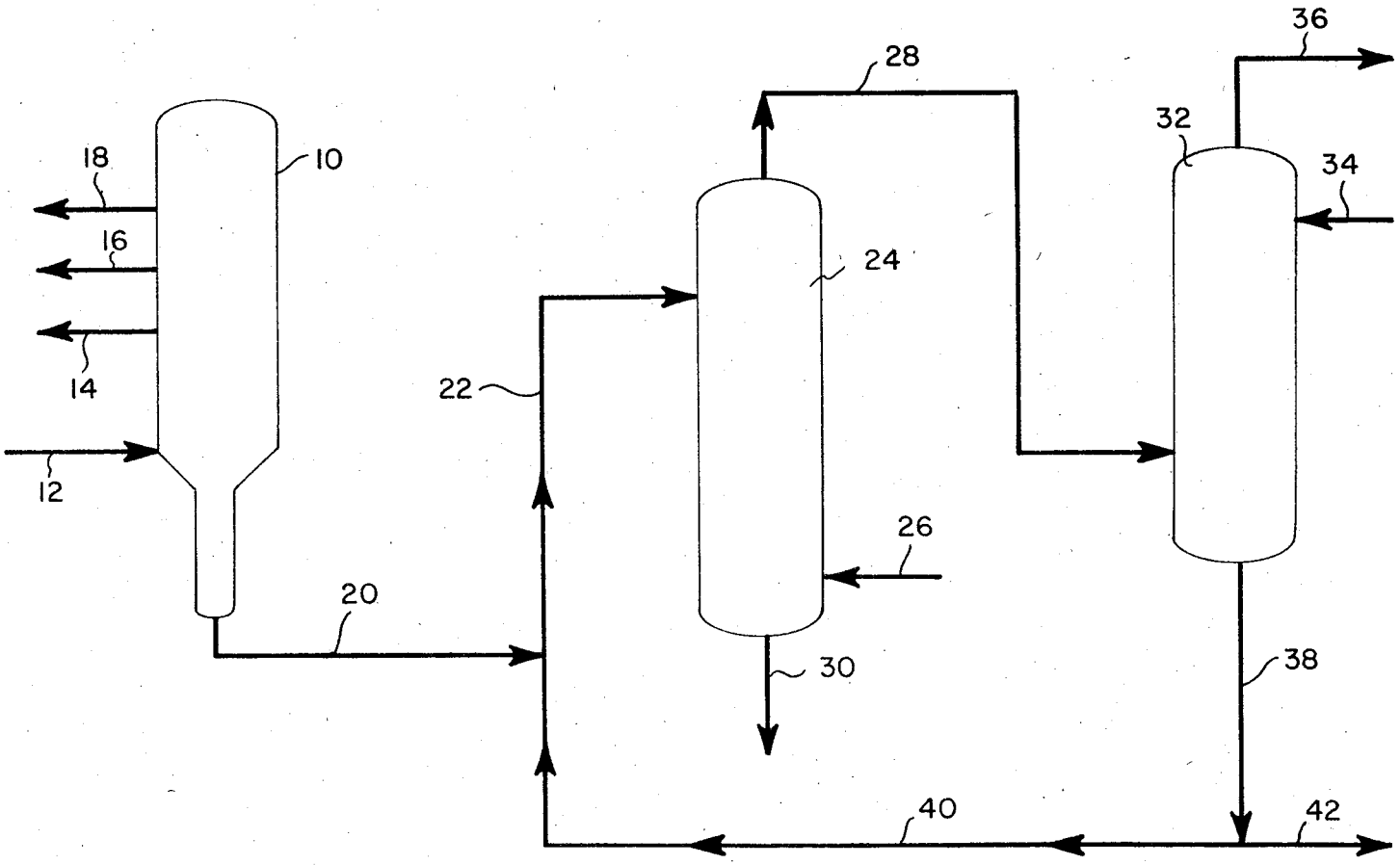
FIG. 1 is a simplified flow diagram illustrating apparatus and connections of one embodiment for practicing the subject invention.

An understanding of the improved process of the subject invention and details for carrying it out can readily be obtained by referring to FIG. 1.

In FIG. 1, a hydrocarbon feedstock such as a reduced crude, suitable for lube oil production, enters the vacuum distillation zone 10 through line 12. Distillate is shown being withdrawn from zone 10 through lines 14, 16 and 18. Vacuum residuum from zone 10 suitable for lube oil production passes through line 20 and is mixed with an aromatic extract oil (line 40) in line 22 and passed into (a first extraction zone) being deasphalting zone 24. The feed to zone 24 countercurrently contacts a low molecular weight hydrocarbon solvent such as propane, which enters through a line 26, producing a deasphalted lube oil (DAO) solution exiting through line 28 and an asphaltic residue exiting through line 30. The deasphalted oil after propane stripoff enters a second extraction zone 32, through line 28, where it is countercurrently contacted with an aromatics solvent (for extracting aromatics including benzene, toluene and xylene) such as N-methylpyrrolidone (NMP) or phenol, which enters through upper line 34. A saturates-rich Bright Stock oil raffinate solution passes out of zone 32 through upper line 36 and the extract oil solution, comprised of dissolved extracted aromatics and recoverable raffinate passes out through lower line 38. After separation of the extraction solvent NMP from a portion of the extract oil solution, this portion of the extract oil is then passed through line 40 and admixed with the vacuum residuum feed entering from line 20 in the amount of 10–20 LV %, based on said residuum, in line 22 to the deasphalter. The added extract oil increases the total LV % of deasphalter feed to the deasphalter. The remainder of the extract oil in line 38 is passed to a cat cracker unit or other suitable disposition through line 42. The obtained Bright Stock raffinate oil via recycle in line 36 is present in a substantially greater amount based on the same amount of starting vacuum residuum, as deasphalter feed, as compared to that obtained from vacuum residuum not admixed with recycled extract oil in the base case.

The yield of Bright Stock raffinate oil obtained from vacuum residuum is generally in the range of about 3.3 LV %, based on the residuum. Use of extract oil recycle according to the present invention, significantly increases the amount of recoverable Bright Stock raffinate oil to values above 3.5 LV %.

Distillation zone 10 typically comprises a vacuum distillation zone, or vacuum pipestill. Distillation zone 10 commonly is a packed or a trayed column. The bottoms temperature of zone 10 typically is maintained within the range of about 350° to about 450° C., while the bottoms pressure is maintained within the range of 5 to about 15 cm Hg. The specific conditions employed be a function of several variables, including the feed utilized, the distillate specifications, and the relative amounts of distillate and bottoms desired. Typically, the resulting vacuum residuum obtained comprises between about 10 and about 50 weight percent of the total residuum feed in line 12, and has a boiling point (1 atm.) above about 370° C.

The operation of deasphalting zones is well-known by those skilled in the art. Deasphalting zone 24 typically will comprise a contacting zone, preferably a countercurrent contacting zone, in which the hydrocarbon feed entering through line 22 is contacted with a solvent, such as a liquid light alkane hydrocarbon. Deasphalting zone 24 preferably includes internals adapted to promote intimate liquid-liquid contacting, such as sieve trays or shed row contactors. The extract stream, comprising deasphalted oil and a major portion of the solvent, exits the deasphalting zone 24 for further separation of the deasphalted oil from the solvent, with the solvent fraction recirculated via line 40 to deasphalting zone 24 for reuse. The preferred solvents generally used for deasphalting include $C_2$–$C_8$ alkanes, i.e., ethane, propane, butane, pentane, hexane, heptane and octane, with the most preferred being propane for lube oil processing. The operating conditions for deasphalting zone 24 are dependent, in part, upon the solvent utilized, the characteristics of the hydrocarbon feedstock, and the physical properties of the deasphalted oil or asphalt desired. The solvent treat typically will range between about 200 liquid-volume percent (LV %) and about 1000 LV % of the residuum feed added to deasphalting zone 24. A discussion of deasphalting operation is presented in Advances in Petroleum Chemistry and Refining, Volume 5, pages 284–291, John Wiley and Sons, New York, N.Y. (1962), disclosure of which is incorporated by reference.

The operation of lube oil extraction zones is well known to those skilled in the art. Extraction zone 32 typically comprises a contacting zone, preferably a countercurrent contact zone, in which the hydrocarbon feed entering through line 28 is contacted with an aromatic solvent, such as N-methylpyrrolidone (NMP) furfural or phenol. Extraction zone 32 preferably has internals designed to promote intimate liquid-liquid contact. The raffinate stream comprising a major portion of the saturates and a small portion of the extraction solvent, exits the extraction zone through line 36 for further separation of the raffinate from the solvent fraction, with the solvent fraction recirculated to extraction zone 32 for reuse. The extract stream, comprising a major proportion of the aromatics and a major portion of the extraction solvent, exits the extraction zone through line 38 for further separation of the aromatics from the solvent fraction, with the solvent fraction recirculated to extraction zone 32 for reuse. The operating conditions for extraction zone 32 are dependent in part, upon the solvent utilized, the characteristics of the hydrocarbon feedstock, and the physical properties of the raffinate oil desired. The solvent treat will typically range from 100 to 400 LV % of the DAO feed to the extraction zone 32 and contain 0.5 to 6.0 LV % water.

The following examples are illustrative of the best mode of carrying out the subject invention process as contemplated by the inventors and should not be construed as being a limitation on the scope and spirit of the instant invention.

EXAMPLE 1

To illustrate the instant invention, Arabian Light Vacuum Resid (residuum) from a vacuum distillation zone and an extract oil derived from an Arabian Light DAO (deasphalted oil) were the deasphalter feed materials utilized during a deasphalting process with propane solvent. Typical properties of the two materials are summarized below in Table 1.

TABLE 1

| Typical Component Feed Properties | Arabian Light Vacuum Resid | Arabian Light Bright Stock Extract Oil |
|---|---|---|
| Viscosity, cSt @ 100° C. | 740 | 72 |
| Density, kg/dm$^3$ @ 15° C. | 1.0162 | 0.9882 |
| CCR, wt. % | 20.0 | 6.0 |
| Refractive Index @ 75° C. | — | 1.5372 |

Figure 2:
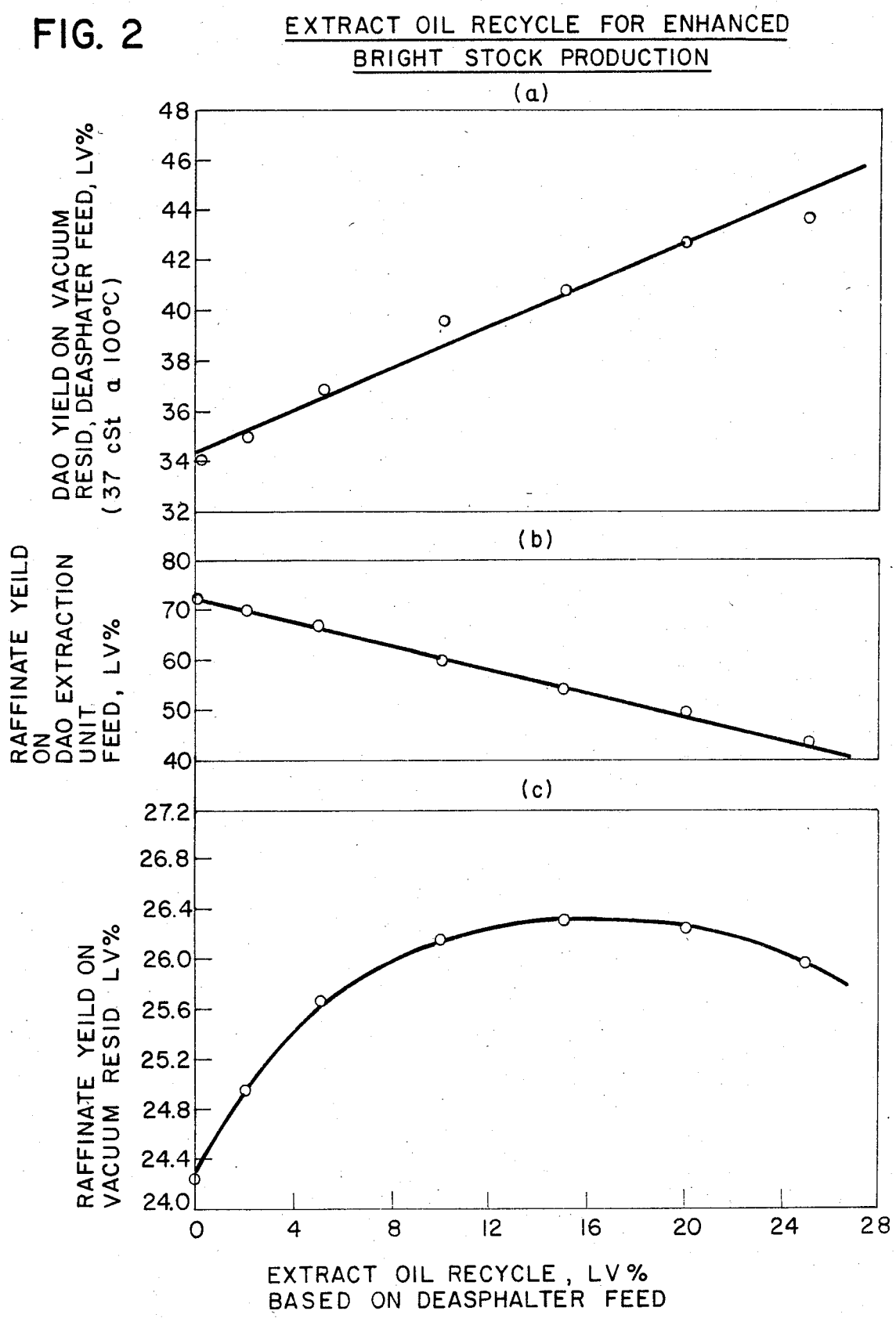

The increase in Arabian Light Bright Stock oil production was demonstrated by admixing in the FIG. 2 listed LV % proportions, the above-described Arabian Light extract oil stream (40), being the extract from the solvent extraction of an Arabian Light deasphalted oil, with the above-described Arabian Light Vacuum Residuum as a deasphalter feed.

The extract oil was mixed with the vacuum residuum in a 10–20 LV % based on the residuum, which was in addition to the amount of residuum normally used resulting in a greater LV % of total feed mixture. In FIG. 2, the values in (a) for DAO yield are based on the total vacuum residuum/extract oil deasphalter feed; the values in (b) for raffinate yield are based on the DAO to the extraction unit and the values in (c) for increased raffinate yield, being Bright Stock basestock oil, as a result of the recycle, are based on the total vacuum residuum-/extract oil deasphalter feed.

The deasphalter feedstock mixture was contacted with propane solvent in the deasphalter per standard procedure. The DAO was then extracted with NMP to Bright Stock quality specifications and the appropriate LV % extract oil, after NMP strip off, recycled to the deasphalter and the process repeated. The yields for the deasphalting, extraction and overall Bright Stock base oil (raffinate) have been presented graphically in FIGS. 2(*a–c*) as a function of added LV % Extract Oil recycle. As seen in FIG. 2(*a*), the DAO yield increases with increasing Extract Oil recycle while the LV % Raffinate yield in (b) based on total extraction yield decreases. The combination of these effects results in a maximum increase in Raffinate yield, i.e., Bright Stock production as seen in FIG. 2(*c*) in the 10–20 LV % range, and particularly at 15 LV % Extract Oil recycle. Recycle at levels below 10 LV % results in sharply reduced Bright Stock yields, and recycle levels above 20 LV %, renders it difficult to maintain the Bright Stock Conradson Carbon Residue (CCR) quality specification.

This latter effect is clearly seen in Table 2 wherein the dewaxed raffinate oil qualities are compared with 0 and 20 LV % extract oil recycle.

TABLE 2

| Variation in Dewaxed Raffinate Oil Properties with Extract Oil Recycle | | |
|---|---|---|
| Dewaxed Raffinate Oil Properties | Extract Oil Recycle LV% 0 | 20 |
| Viscosity, cSt. @ 100° C. | 37 | 37 |
| Viscosity Index | 95 | 95 |
| Pour Point, °C. | −9 | −9 |
| Sulphur, wt. % | 1.35 | 1.53 |
| Conradson Carbon Residue, wt. % | 0.70 | 1.0 |

Conventional downstream processing (HYDROfining) reduces the dewaxed raffinate oil CCR by 0.3 wt. % which brings the 20 LV % recycle case down to 0.7 wt. % which is equivalent the Bright Stock CCR specification. Recycling more than 20 LV % extract oil makes it very difficult to meet the Bright Stock CCR specification and is unacceptable in a conventional refinery operation.

EXAMPLE 2

Utilizing the apparatus and general procedure described above in Example 1, a comparative run was made using no recycle versus one using 15 LV % extract oil in the deasphalter/extraction steps. The base case run is indicated by numeral (1) and the recycle case as (2).

As seen from the results depicted in the flow diagram of FIG. 3, starting with 1.0 liquid volume (LV) of vacuum residuum in the base case led to a 34% production of deasphalted oil (DAO), after propane extraction. Subsequent NMP solvent extraction produced 72% yield of raffinate based on the DAO resulting in 0.245 LV raffinate based on starting vacuum residuum as deasphalter feed.

By contrast, starting with 1.0 LV of vacuum resid, together with 0.175 LV of extract oil, representing a 15 LV % recycle, led to a 41% yield of DAO after deasphalting. Subsequent NMP extraction produced 55% yield of raffinate based on the DAO resulting in 0.265 LV raffinate. This represents an 8.2% increase in production of raffinate based on starting vacuum resid as compared to the base case involving no recycle.

What is claimed is:

1. In a process for increasing the amount of Bright Stock raffinate oil derived from the solvent extraction of deasphalted lube oil involving the steps of:

(a) extracting a vacuum residuum with a low molecular weight alkane hydrocarbon solvent resulting in a deasphalted lube oil solution and asphaltic residue;

(b) separating said deasphalted lube oil and said residue;

(c) separating said hydrocarbon solvent from said deasphalted lube oil;

(d) extracting said deasphalted lube oil obtained from step (c) with an aromatics solvent resulting in a Bright Stock raffinate oil solution and an extract oil solution, said extract oil solution comprised of dissolved aromatics and recoverable raffinate;

(e) separating said raffinate solution from said extract oil solution obtained from step (d); and (f) separating said aromatics solvent from said extract oil solution obtained from step (e); in which said improvement comprises the steps of:

(g) recycling said extract oil from which the aromatics solvent has been removed, obtained from step (f), to step (a) and combining said extract oil with said vacuum residuum in a 10–20 LV %, based on said residuum, prior to said deasphalting;

(h) repeating step (a);

(i) repeating step (b);

(j) repeating step (c);

(k) extracting said deasphalted oil obtained from step (j) with said aromatics solvent resulting in said Bright Stock raffinate oil and said extract oil, wherein said obtained raffinate is present in a substantially greater amount, based on said vacuum residuum, as compared to said raffinate obtained in step (d).

2. The process of claim 1 wherein said extract oil is combined with said vacuum residuum in step (g) in about 15 LV % prior to said deasphalting.

3. The process of claim 1 wherein said hydrocarbon solvent in step (a) is propane.

4. The process of claim 1 wherein said aromatics solvent in step (d) is N-methylpyrrolidone.

5. The process of claim 1 wherein said obtained Bright Stock raffinate oil exhibits a Conradson Carbon Residue value of about 1.0 weight percent or less.

* * * * *